US010066915B1

(12) United States Patent
Hall et al.

(10) Patent No.: US 10,066,915 B1
(45) Date of Patent: Sep. 4, 2018

(54) MULTI-PURPOSE STATE CHANGING MUNITION

(71) Applicant: The United States of America as Represented by the Secretary of the Army, Washington, DC (US)

(72) Inventors: Matthew Hall, Hamburg, NJ (US); Jessica Perciballi, Parsippany, NJ (US); Tim Madsen, Wharton, NJ (US); Jack Pincay, Union City, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/709,713

(22) Filed: Sep. 20, 2017

Related U.S. Application Data

(60) Provisional application No. 62/397,467, filed on Sep. 21, 2016.

(51) Int. Cl.

| | |
|---|---|
| ***F42B 27/00*** | (2006.01) |
| *F42B 12/56* | (2006.01) |
| *F42B 12/32* | (2006.01) |
| *F42B 12/24* | (2006.01) |

(52) U.S. Cl.
CPC ..... *F42B 27/00* (2013.01); *F42B 12/24* (2013.01); *F42B 12/32* (2013.01); *F42B 12/56* (2013.01)

(58) Field of Classification Search
CPC ..... F42B 27/00; F42B 12/24; F42B 12/32; F42B 12/56; F42B 12/22
USPC ..... 102/489, 482
See application file for complete search history.

(56) References Cited

U.S. PATENT DOCUMENTS

| | | | | | |
|---|---|---|---|---|---|
| 2,023,158 | A * | 12/1935 | Williams | F42B 12/24 | 102/482 |
| 2,330,490 | A * | 9/1943 | Hibbs | F42B 27/00 | 102/487 |
| 4,106,410 | A * | 8/1978 | Borcher | F42B 12/22 | 102/495 |
| 4,493,264 | A * | 1/1985 | Jameson | F42B 12/32 | 102/476 |
| 4,781,118 | A * | 11/1988 | Assmann | F42B 12/20 | 102/482 |
| 4,817,532 | A * | 4/1989 | Assmann | F42B 12/20 | 102/482 |
| 4,982,668 | A * | 1/1991 | Bender | F42B 12/32 | 102/495 |
| 5,131,329 | A * | 7/1992 | Lips | F42B 12/24 | 102/364 |
| 6,135,028 | A * | 10/2000 | Kuhns | F42B 12/06 | 102/265 |
| 6,792,868 | B2 * | 9/2004 | Teilhol | F42C 14/02 | 102/482 |

(Continued)

*Primary Examiner* — Joshua E Freeman
(74) *Attorney, Agent, or Firm* — John P. DiScala

(57) ABSTRACT

A multi-purpose munition operates in either a blast mode or a fragmentation mode according to a user input. When operating in the fragmentation mode, a fuze initiates a main explosive fill of the munition which in turn disperses fragments formed from a fragmentation layer of the munition. When operating in a blast mode, prior to initiating the main explosive fill, the fuze initiates a secondary energetic layer which discards the fragmentation layer. The fuze then initiates the main explosive fill thereby producing a blast effect.

17 Claims, 3 Drawing Sheets

(56) References Cited

U.S. PATENT DOCUMENTS 7,197,983 B2 * 4/2007 Barth ..... F42C 11/003 102/207
8,136,437 B2 * 3/2012 Van Stratum ..... F42B 33/025 102/368
8,365,670 B2 * 2/2013 Abramov ..... F42B 12/24 102/482
8,381,657 B1 * 2/2013 Hooke ..... F42B 8/26 102/481
8,671,840 B2 * 3/2014 Scheid ..... F42B 12/32 102/495
8,887,640 B1 * 11/2014 Knight ..... F42C 14/025 102/210
9,243,876 B1 * 1/2016 Botthof ..... F42B 12/22
9,470,495 B2 * 10/2016 Kravel ..... F42B 12/72
2005/0087088 A1 * 4/2005 Lacy ..... F42B 12/24 102/495
2007/0266883 A1 * 11/2007 Law ..... F42B 12/60 102/482
2008/0006171 A1 * 1/2008 Confer ..... F42B 12/08 102/497
2011/0232466 A1 * 9/2011 Stratum ..... F42B 27/08 86/1.1
2012/0186481 A1 * 7/2012 Abramov ..... F42B 12/24 102/482
2012/0192753 A1 * 8/2012 Scheid ..... F42B 12/32 102/495
2012/0192754 A1 * 8/2012 Scheid ..... F42B 12/24 102/495
2012/0266773 A1 * 10/2012 Eckstein ..... F42B 5/03
2013/0186295 A1 * 7/2013 Kravel ..... F42B 12/56 102/487
2016/0025468 A1 * 1/2016 Botthof ..... F42B 1/02 102/475
2016/0273898 A1 * 9/2016 Kravel ..... F42B 12/72

* cited by examiner

MULTI-PURPOSE STATE CHANGING MUNITION

CROSS-REFERENCE TO RELATED APPLICATIONS

This application claims the benefit under 35 USC § 119(e) of U.S. provisional patent application 62/397,467 filed on Sep. 21, 2016.

STATEMENT OF GOVERNMENT INTEREST

The inventions described herein may be manufactured, used and licensed by or for the United States Government.

BACKGROUND OF THE INVENTION

The invention relates in general to munitions and in particular to multi-purpose munitions.

Energetic devices such as grenades, mortars and artillery rounds serve to perform a dedicated or specific mission. Munitions may be employed to provide lethality, smoke, concussion or shock effects. However, munitions are currently designed to provide a single capability. This does not allow the warfighter to quickly respond to today's quickly changing battlefield without increased physical burden.

With the variety of effects needed in modern Field Engagements, single purpose munitions can prove to be a logistical and economic hindrance. Drawbacks include overall unit cost of each munition, the need to transport and store a large number of munitions and safety issues related to energetic devices.

Multi-purpose munitions exist; however, current approaches are inadequate. One known solution provides a grenade which may be used as both a fragmentation and concussion grenade. There are drawbacks to this solution as manual removal of the fragmentation skin is required to switch from lethal to non-lethal mode. This is a time consuming process for a soldier in the field and may be irreversible. Scalable munitions are another known approach. However, these munitions also require manual assembly by the user.

A need exists for an improved multi-purpose munition which does not require manual assembly or disassembly to switch from one mode to another.

SUMMARY OF INVENTION

One aspect of the invention is a multipurpose munition which is selectably operable in a fragmentation mode and a blast mode. The munition includes a main explosive fill, a secondary energetic layer, a fragmentation layer and a fuze. According to a user selection, the fuze initiates an energetic chain corresponding to fragmentation mode or an energetic chain corresponding to a blast mode. The energetic chain corresponding to the blast mode comprises a detonation of the secondary energetic layer to remove the fragmentation layer at a predetermined time prior to a detonation of the main explosive fill.

A second aspect of the invention is a method for operating a multi-purpose munition. The method comprises the steps of receiving a selection of an operation mode at the munition wherein the selection comprises a fragmentation mode or a blast mode, receiving an activation action at the munition, initiating an energetic chain corresponding to the selection of the operation mode.

A third aspect of the invention is a multi-purpose grenade selectably operable in a fragmentation mode or a blast mode. The grenade has a core of aluminized HMX surrounded by successive concentric layers of steel, polyurethane and energetic ink housed in a spherical shell comprised of tungsten fragments in a binder. The grenade further comprises a fuze and a selection interface in communication with the fuze. According to a user selection received at the selection interface, the fuze initiates an energetic chain corresponding to fragmentation mode or an energetic chain corresponding to a blast mode.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A selectable multipurpose munition offers the benefit of a grenade capable of producing two effects in one unit. A user may select either a blast mode or a fragmentation mode and upon activation of the munition, a fuze of the munition will initiate an energetic chain to produce either a blast effect or a fragmentation effect, respectively.

Advantageously, the multi-purpose munition increases capability options and effectiveness while reducing physical and logistical burdens. By providing both effects in a single munition, the payload which must be carried by the user or transported may be reduced. The multi-purpose munition provides flexibility and ease of use to the warfighter. Either effect may be quickly and easily selected via a simple action by the warfighter. Additionally, prior to activation, the selection may be reversed thereby providing flexibility to the warfighter.

Figure 1:
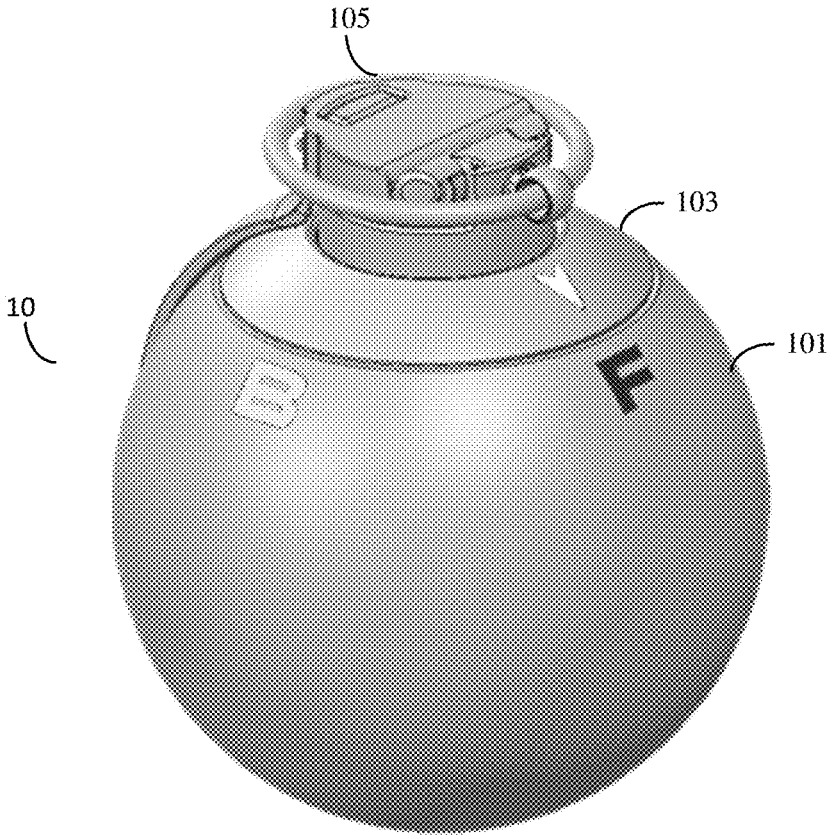
FIG. 1 is a perspective view of a multi-purpose grenade, in accordance with one illustrative embodiment.

FIG. 1 is a perspective view of a multi-purpose grenade, in accordance with one illustrative embodiment. The multi-purpose grenade 10 selectably operates in a fragmentation mode and a blast mode. In the fragmentation mode of operation, activation of the grenade results in a fragmentation effect in which a plurality of fragments are dispersed at a high velocity. In the blast mode of operation, activation of the grenade results in a concussive blast.

While throughout this specification, the munition will be described in the context of a multi-purpose grenade 10, the munition is not limited to a grenade. The munition may be an artillery round, mortar round, rocket round or any other munition which may operate in more than one mode. Additionally, the munition is not limited to operating in a fragmentation mode and a blast mode. Other embodiments may allow the user to switch between some combination of one or more of the following modes of the munition: lethal mode, non-lethal mode, fragmentation mode, blast mode, smoke mode, illumination mode or other munition modes contemplated by those skilled in the art.

The multi-purpose grenade 10 comprises a housing 101, a selection interface 103 and an activation assembly 105. The selection interface 103 and activation assembly 105 protrude through an opening in the top of the housing 101 to allow for user manipulation.

The selection interface 103 provides a mechanism for a user to select the desired operation mode. The selection interface 103 communicates with a fuze of the munition to set the fuze to operate according to the desired operation mode. In the embodiment shown in FIG. 1, the selection interface 103 comprises a manual selection knob which the user rotates to select the desired mode. Labels disposed on the housing 101 indicate whether the grenade 10 is set to operate in either the fragmentation mode, denoted by an "F", or a blast mode, denoted by a "B".

The selection interface 103 may be switched between one mode and the other prior to activation of the grenade 10. Advantageously, the user is provided flexibility of choice up to the moment of activation.

The activation assembly 105 activates the grenade 10 for use and further comprises a lever and a pull-pin. Upon removal of the pull-pin and release of the lever, the activation assembly 105 initiates the fuze. The fuze then operates according to the mode selected by the user.

The housing 101 is a spherical shell which houses the internal components of the grenade 10 and provides protection from the external environment. As will be described in further detail below, the housing 101 additionally serves as the fragmenting layer of the grenade 10 and provides the fragmentation effects when the grenade 10 is operating in the fragmentation mode.

Figure 2:
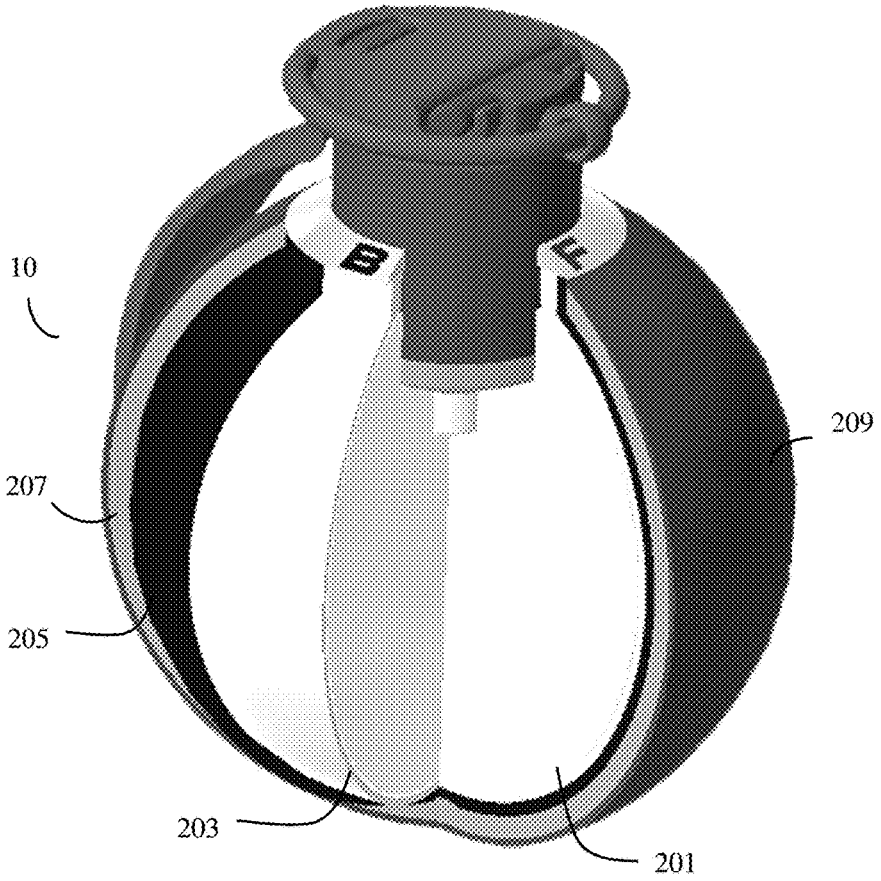
FIG. 2 is a cross-sectional perspective view of the multi-purpose grenade, in accordance with one illustrative embodiment.
Figure 3:
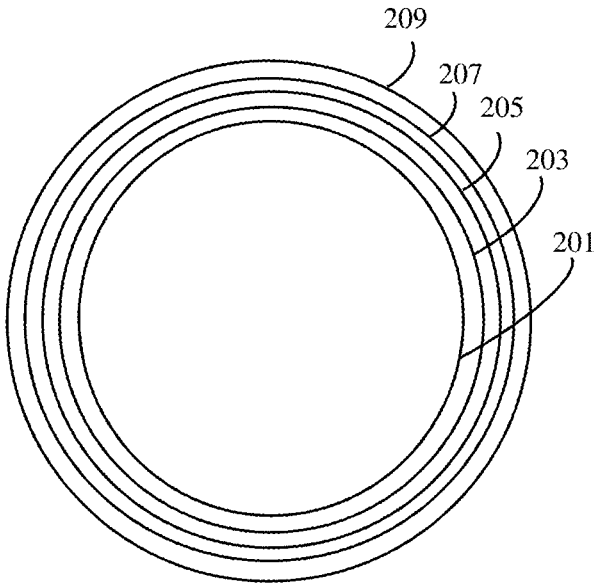
FIG. 3 is a cross-sectional bottom plan view of the multi-purpose grenade, in accordance with one illustrative embodiment.

FIG. 2 is a cross-sectional view of the multi-purpose grenade, in accordance with one illustrative embodiment. FIG. 3 is a cross-sectional bottom plan view of the multi-purpose grenade, in accordance with one illustrative embodiment. The grenade 10 comprises a main explosive fill 201 surrounded by concentric layers comprising a pusher layer 203, a buffer layer 205, a secondary energetic layer 207 and a fragmenting layer 209.

The main explosive fill 201 provides the primary energetic effect of the grenade 10 and is capable of providing blast overpressure and fragment dispersion. In an embodiment, the main explosive fill 201 is comprised of an aluminized HMX-based explosive. However, the main energetic is not limited to an HMX-based explosive and in other embodiments may be another explosive with similar capabilities.

When operating in a fragmentation mode, the energetic chain is initiated as in a typical fragmentation grenade with the main explosive fill 201 being detonated initially which results in high density fragments from the fragmentation layer being projected at high velocity into the environment. In the blast mode, the fragmentation layer is first shed by a preliminary detonation of the secondary energetic layer 207 prior to the detonation of the main explosive fill 201. Without the fragmentation layer, the main energetic fill produces concussive effects.

The pusher layer 203 is a rigid shell which provides insulation to the main explosive fill 201 and aids in transferring the explosive energy of the main explosive fill 201 to disperse the fragments. In the embodiment shown, the pusher layer 203 is a 1/32 inch thick shell of 4340 steel. However, the pusher layer is not limited to steel. In other embodiments, the pusher layer is a shell of aluminum.

The buffer layer 205 is a shock absorbing layer which separates the main explosive fill 201 and pusher layer 203 from the secondary energetic layer 207 and absorbs shock resulting from the initial detonation of the secondary energetic layer 207 when operating in blast mode. The buffer layer 205 aids in ensuring that the main explosive fill 201, pusher layer 203 and fuze assembly maintain structural integrity after initiation of the secondary energetic layer 207. In the embodiment shown the buffer layer 205 is a 1/16 inch thick shell of impact resistant polyurethane.

The secondary energetic layer 207 provides tuned energetic effects to fracture and remove the fragmentation layer from the grenade 10 when operating in the blast mode. When operating in the fragmentation mode, the secondary energetic layer 207 performs a sympathetic function with the main explosive fill 201. In the embodiment shown, the secondary energetic layer 207 is explosive ink (i.e. a CL-20 based, paste-like, extrudable explosive). The explosive ink is filled into voids within the buffer layer 205 such that an evenly distributed force could be transferred to the fragmentation layer to break and discard it while still allowing the buffer layer 205, pusher layer 203 and main explosive fill 201 to maintain their structural integrity and not cause the main explosive fill 201 to sympathetically detonate. Advantageously, by only requiring a small amount of energetic material to the discard the fragmenting layer 209, the fragmenting layer 209 allows the interior layers of the grenade 10 to maintain their integrity during the initiation of the secondary energetic layer 207.

The fragmenting layer 209 provides a protective layer from the external environment for the interior layers. When the multi-purpose grenade 10 is operating in the fragmentation mode, the fragmenting layer 209 is fragmented by the explosive energy of the main explosive fill 201 and the secondary energetic layer 207 and the resulting high density fragments are propelled at high velocity from the grenade 10. When the multi-purpose grenade 10 is operating in the blast mode, the fragmenting layer 209 is discarded by the secondary energetic layer 207 prior to initiation of the main explosive fill 201. In the embodiment shown, the fragmenting layer 209 comprises a matrix of tungsten spheres with thermoplastic elastomer injection molding as a binder.

The fragmentation mode of operation involves a single detonation by the fuze as opposed to the blast mode of operation. The main explosive fill 201 is pyrotechnically detonated by the fuze.

All layers remain intact prior to the outward movement of explosive energy. In response to the outward movement of explosive energy, each layer will experience some form of failure. During detonation, the pusher layer 203 expands in response and facilitates transfer of the energetic force of the main explosive fill 201 to the subsequent layers and aids in the dispersion of the high density fragments.

The buffer layer 205 fails mechanically in response to the expanding pusher layer 203 and is consumed.

The secondary energetic layer 207 is detonated by the expanding main explosive fill 201 and the pusher layer 203. The secondary energetic layer 207 performs a sympathetic function with the main explosive fill 201.

The fragmentation layer is fragmented into various size fragments and expelled at a high velocity.

The blast mode of operation comprises an initial detonation of the secondary energetic layer 207 by the fuze and a subsequent detonation of the main explosive fill 201 by the fuze.

Upon activation of the grenade 10, the fuze detonates the secondary energetic layer 207. The explosive energy of the secondary energetic layer 207 fractures the fragmenting layer 209 thereby discarding the fragmenting layer 209 from the grenade 10. The design of the energetic layer 207 and the fragmenting layer 209 allow the removal of the fragmenting layer 209 with a low level output of the secondary energetic layer 207. The low level output also prevents inadvertently detonating the main explosive fill 201.

The pusher layer 203, buffer layer 205 and main explosive fill 201 retain their structural integrity during and subsequent to the detonation of the secondary energetic layer 207.

With the fragmenting layer 209 removed, the energetic main fill can be detonated without risk of lethal fragments. After a set time delay to allow for removal of the fragmenting layer 209, the fuze pyrotechnically detonates the main explosive fill 201. Without the fragmenting layer 209, the main explosive fill 201 is limited to producing a blast effect. The pusher layer 203 and boundary layer mechanically fail in response to the detonation of the main explosive fill 201.

While the invention has been described with reference to certain embodiments, numerous changes, alterations and modifications to the described embodiments are possible without departing from the spirit and scope of the invention as defined in the appended claims, and equivalents thereof.

What is claimed is:

1. A multi-purpose munition selectably operable in a fragmentation mode and a blast mode, the munition comprising:

a main explosive fill;

a secondary energetic layer;

a fragmentation layer; and a fuze which initiates according to a user selection, either a first energetic chain corresponding to a fragmentation mode or a second energetic chain corresponding to a blast mode.

2. The multi-purpose munition of claim 1 wherein:

when operating in the fragmentation mode, the fuze initiates the main explosive fill thereby causing dispersion of a plurality of fragments formed from the fragmenting layer; and when operating in the blast mode, the fuze initiates the secondary energetic layer a predetermined time prior to initiating the main explosive fill such that the fragmenting layer is discarded prior to the detonation of the main explosive fill.

3. The multi-purpose munition of claim 2 further comprising a buffer layer between the main explosive fill and the secondary energetic layer.

4. The multi-purpose munition of claim 3 wherein the secondary energetic layer is an explosive ink deposited in cavities in the buffer layer.

5. The multi-purpose munition of claim 4 wherein the explosive ink is a CL-20 based extrudable explosive.

6. The multi-purpose munition of claim 4 wherein the buffer layer is a layer of polyurethane.

7. The multi-purpose munition of claim 3 further comprising a pusher layer between the main explosive fill and the secondary energetic layer for aiding the dispersion of fragments.

8. The multi-purpose munition of claim 7 wherein the pusher layer is a steel shell surrounding the main explosive fill.

9. The multi-purpose munition of claim 7 wherein the buffer layer, pusher layer and main explosive fill remain intact after ignition of the secondary energetic charge.

10. The multi-purpose munition of claim 1 wherein the fragmentation layer comprises a plurality of tungsten fragments suspended in a binder.

11. The multi-purpose munition of claim 1 wherein the main explosive fill is an HMX based explosive.

12. The multi-purpose munition of claim 1 further comprising a selection interface in communication with the fuze and operable to receive an input for setting the fuze to operate in fragmentation mode or blast mode.

13. The multi-purpose munition of claim 12 wherein the selection is reversible prior to activation of the fuze.

14. A method for operating a multi-purpose munition comprising the steps of:

receiving an operation mode from a selection interface wherein the munition may operate in a blast mode or a fragmentation mode;

receiving an activation action at the munition; and initiating an energetic chain corresponding to the selection of the operation mode.

15. The method of claim 14 wherein when operating in the blast mode, the method further comprises the steps of:

detonating a secondary energetic charge;

discarding a fragmentation layer of the munition with the secondary energetic charge;

at a predetermined time after initiating the secondary charge, detonating a main explosive fill to produce a blast effect.

16. The method of claim 14 wherein when operating in the fragmentation mode, the method further comprises the steps of:

igniting a main explosive fill;

expanding a pusher layer surrounding the main explosive fill;

sympathetically detonating a secondary energetic charge;

dispersing fragments formed from a fragmentation layer.

17. A multi-purpose grenade selectable operable in either a fragmentation mode or a blast mode, the multi-purpose grenade comprising a fuze and an HMX core surrounded by successive concentric layers further comprising a steel shell layer, a polyurethane layer, CL-20 based explosive ink deposited in cavities formed in the polyurethane layer and a fragmentation layer further comprising a plurality of tungsten fragments in a binder and wherein:

when operating in the fragmentation mode, the fuze initiates the HMX core thereby causing dispersion of a plurality of fragments formed from the fragmenting layer; and when operating in the blast mode, the fuze initiates the CL-20 based explosive ink a predetermined time prior to initiating the main energetic charge such that the fragmenting layer is discarded prior to the detonation of the main energetic charge.

* * * * *